United States Patent [19]

Dietzel et al.

[11] 4,008,098

[45] Feb. 15, 1977

[54] PROCESS AND APPARATUS FOR CONTINUOUSLY PRODUCING A HIGH CONCENTRATION SUGAR SOLUTION

[75] Inventors: Walter Dietzel; Siegfried Matusch; Helmut Schaper; Erwin Zeichner, all of Braunschweig, Germany

[73] Assignee: Braunschweigische Maschinenbauanstalt, Braunschweig, Germany

[22] Filed: Dec. 10, 1975

[21] Appl. No.: 639,223

[30] Foreign Application Priority Data

Nov. 11, 1974 Germany ..... 2550496

[52] U.S. Cl. ..... 127/19; 127/22; 127/56; 233/12; 233/14 R

[51] Int. Cl.[2] ..... B04B 15/00; C13F 1/00

[58] Field of Search ..... 127/19, 56, 22; 233/12, 233/14 R

[56] References Cited

UNITED STATES PATENTS

| | | | |
|---|---|---|---|
| 3,650,465 | 3/1972 | Grimwood | 127/19 X |
| 3,730,769 | 5/1973 | Fiedler | 127/19 |

*Primary Examiner*—Morris O. Wolk
*Assistant Examiner*—Sidney Marantz
*Attorney, Agent, or Firm*—W. G. Fasse; W. W. Roberts

[57] ABSTRACT

A high concentration sugar solution is produced by contacting sugar crystals as they emerge from a centrifuging basket, with pressurized solvent liquid sprayed from a plurality of nozzles to form a turbulent mist of solvent and to envelope the sugar crystals which are forced to travel through said turbulent mist of solvent to impinge upon a baffle guide ring. The turbulent flow of solvent mist and solvent enveloped sugar crystals is guided along said baffle guide ring to a back-up location, where sugar solution, air, and liquid mist are forced through a gap and over a damming ring wall surrounding the gap. The centrifuge for performing the foregoing process includes a centrifuging basket with an upper rim over which the sugar crystals emerge. A solvent supply ring with nozzles facing toward the rim is arranged above the upper basket rim. The baffle guide ring curves downwardly and surrounds an inner housing which in turn surrounds the basket. The lower edge of the baffle guide ring forms with an inner bottom connecting said inner and an outer housing, said gap through which the solution, air and liquid mist are forced.

12 Claims, 2 Drawing Figures

PROCESS AND APPARATUS FOR CONTINUOUSLY PRODUCING A HIGH CONCENTRATION SUGAR SOLUTION

BACKGROUND OF THE INVENTION

The present invention relates to a process and apparatus for continuously producing a high concentration sugar solution. The present apparatus includes a continuously operating centrifuge to which the massecuite is continuously supplied. The centrifuged sugar crystals are contacted by a solvent liquid in such a manner as to enhance the solving action whereupon the solution is removed from the centrifuge.

A centrifuge which may be modified for the present purposes includes a screen basket, which is rotatable about a vertical axis. The screen basket is surrounded by an inner housing providing a collection space for the liquid separated from the sugar crystals. An upper rim of the screening basket extends above the inner housing. The inner housing is surrounded by an outer housing including a cover through which massecuite supply means extend into the basket. Preferably, the massecuite supply means extend down into a distribution cup which is secured to the upper end of a drive shaft for the centrifuging basket.

It is known to produce high purity sugar by guiding a previously purified sugar solution through crystallizing devices, the output of which is the so called massecuite. The massecuite is then separated in centrifuges into a liquid component and into a solid component, the latter constituting the crystallized sugar. Contaminations which might still be present in the starting material are thus retained in the liquid component. However, very small quantities of contaminations also remain in the sugar crystals after the centrifuging. Thus, where it is intended to produce a high purity grade sugar, it is customary to again dissolve the centrifuged sugar crystals, whereupon the solution is again crystallized and subjected to a separation action in a centrifuge Prior to the second crystallization the sugar solution obtained by the second dissolving is passed through suitable filter means.

High concentration and high purity sugar solutions are used for industrial purposes, for example, in the beverage industry. Such sugar solutions are transformed into so called invert sugar in order to prevent the recrystallization. However, before such conversion may be performed, it is necessary to produce the required sugar solution by way of crystallization and again dissolving the crystals and filtering the solution. Heretofore it was customary to employ the batch method where extremely high grades of purity for the sugar solution were desired. However, continuously operating centrifuges have also been employed.

Thus, U.S. Pat. No. 3,730,769, granted May 1, 1973 discloses a method and apparatus wherein a continuously operating centrifuge is employed. The centrifuge of this prior art publication comprises a conical centrifuging basket which is provided at its upper end with a radially extending rim. This rim extends into a so called circular collecting ring pipe arranged coaxially relative to the rotational axis of the centrifuging basket. The circular ring pipe is provided with a slot facing toward the basket so that the basket rim may extend into such slot. The circular ring pipe is supplied with a liquid solvent and an outlet port is operatively connected to the ring pipe at a suitable point for removing the flowable product from the ring pipe. It is the purpose of the ring pipe to again dissolve the sugar crystals which emerge from the centrifuging basket directly into the solvent charged ring pipe. However, practical experience has shown that the ring pipe contains mostly liquid and sugar crystals so that at best only a mash-in is accomplished in this reference. Thus, according to this prior art approach, it is necessary to convey the liquid sugar crystal mixture produced according to German Patent Publication No. 2,025,828 through mixing pumps or through respective solution containers including stirring mechanisms in order to provide a sugar solution which may be filtered.

It appears that in the just mentioned reference there is insufficient time for the sugar crystals to enter into solution in the ring pipe. It is technically not possible to provide the necessary residence time for the sugar crystals in the ring pipe since the latter must not be clogged. Further, where the conditions which influence the solution are the same, the solution itself may only be shortened in time by mechanically influencing the crystal liquid mixture. This is so, because during the dissolving each sugar crystal is enveloped by a coating of a saturated or substantially saturated solution, and it is not possible to mechanically influence such coating inside the just described ring pipe.

A further dissolving is only then possible when the coatings of high sugar concentration are replaced by liquid of low sugar concentration. However, such replacing becomes increasingly more difficult due to the viscosity which also increases with the increasing concentration. Due to these physical facts, it was customary heretofore to produce sugar solution in solution containers provided with respective mechanical stirring devices. The mechanical stirring enhances the exchange or replacement of the envelope layers or coatings of high concentration with such envelope layers or coatings having low sugar concentrations.

In the centrifuge according to German Patent Publication No. 2,025,828 the liquid flows relatively slowly in the collection ring, because a centrifugal effect would be noticeable if the speed becomes too high in the collection ring. Thus, sugar would settle down in the outer range of the collection ring and the liquid flow would not be able to entrain the sugar crystals. However, the speed of flow which is small enough to prevent such sedimentation, is much too small to mechanically influence the solid, liquid mixture so as to noticeably reduce the time duration required for the solution.

In view of the foregoing it will be appreciated that the just described prior art centrifuge discloses features for preventing the so called knot formation or clogging. The clogging or knot formation is almost unavoidable in continuously operating centrifuges from which the sugar is conventionally discharged in a dry state. Such sugar knots or lumps in turn make the subsequent solving of the sugar more difficult. This is avoided by the so called liquid discharge of the sugar from a continuously operating centrifuge, because the solid, liquid mixture may be conveyed relatively easily.

U.S. Pat. No. 2,883,054 discloses a centrifuge in which the sugar discharged from the conical centrifuging drum is sprayed with a liquid in a collecting ring from which the sugar may be rinsed. This reference also mentions that it is possible to dissolve again the sugar in the manner described. However, as mentioned above, this is physically impossible due to the short residence time of the liquid sugar mixture in the collecting ring.

U.S. Pat. No. 3,301,708 discloses another example in which a continuously operating centrifuge comprises a collecting ring surrounding the upper drum rim. The sugar collected in this ring is exposed to a liquid. For this purpose the reference discloses a rotating nozzle body to which the liquid is supplied.

U.S. Pat. No. 3,238,063 describes a continuously operating centrifuge comprising a ring pipe arranged with a relatively large axial spacing from the upper edge of the conical centrifuging basket. The ring pipe is provided with radially outwardly directed nozzle openings for the liquid. In this known centrifuge the sugar discharged over the upper edge of the centrifuging basket impinges upon elastically yielding baffle walls, whereby simultaneously liquid discharging from the nozzles in the ring pipe is applied to the sugar crystals. The purpose of this arrangement is to produce a solid, liquid mixture which may easily be discharged from the centrifuge without the formation of sugar lumps or knots.

OBJECTS OF THE INVENTION

In view of the above, it is the aim of the invention to achieve the following objects singly or in combination:

to provide a method and apparatus for the continuous production of a high concentration sugar solution by dissolving the sugar discharged from the centrifuging basket directly inside the centrifuge in a substantially complete manner;

to control the degree of concentration of the produced sugar solution so as to maintain it at a predetermined high level;

to construct a continuously operating centrifuge capable of simultaneously, continuously producing a high concentration sugar solution, from standard structural elements;

to produce a sugar solution by dissolving again the sugar crystals directly in the centrifuge so that the sugar concentration in the solution will have Brix values in the range of about 60 to 70, whereby no intermediate process steps are to be employed;

to subject the sugar crystals to a solvent liquid at a point where the sugar crystals emerging from the centrifuging basket have their highest speed;

to spray the liquid solvent onto the sugar crystals under pressure and in such a manner that the sugar crystals are forced to travel through a turbulent mist of liquid solvent; and to continuously produce a high concentration sugar solution which simultaneously has a high degree of purity.

SUMMARY OF THE INVENTION

The above objects have been achieved according to the invention by exposing the sugar crystals as they pass over the upper rim of the centrifuging basket, directly to jets of pressurized solvent liquid directed from above onto the sugar crystals at an angle relative to the direction of motion of the sugar crystals, whereby the solvent liquid is transformed into a turbulent flow of a liquid mist due to the intensive air turbulences resulting from the centrifuging of the sugar crystals. The sugar crystals are enveloped with the liquid and are centrifuged or forced to travel through the liquid mist and against a rigid, inclined wall, whereby the liquid crystals upon impinging on the rigid wall are comminuted if necessary and subjected to the turbulences of the liquid mist.

The rigid wall guides the turbulent flow and the sugar crystals therein toward a back-up zone whence the crystals are driven together with air and liquid mist, as well as together with the produced solution through a gap. Upon passing the gap, the crystals are all dissolved and the pure solution is guided over a damming means. After passing the damming means, the solution is discharged from the centrifuge.

A centrifuge according to the invention is characterized in that a circular ring pipe is axially spaced above the upper rim of the centrifuging basket. The ring pipe is provided with nozzles directed toward the rim of the centrifuging basket. The circular ring pipe is connected to a supply conduit for pressurized liquid solvent. A baffle guide ring is arranged concentrically around the inner housing which in turn surrounds the centrifuging basket. The baffle guide ring is radially spaced from the upper rim of the centrifuging basket. The baffle guide ring extends from an area above the upper rim of the centrifuging basket radially outwardly and downwardly relative to the rotational axis of the basket, whereby the baffle plate is preferably curved so that its concave surface faces toward the centrifuging basket. The curvature is such that the radius of curvature diminishes from the area adjacent to the upper basket rim to the lower edge of the baffle guide ring. The lower edge of the baffle guide ring extends to a plane just slightly above an intermediate bottom which interconnects said inner housing with an outer housing of the centrifuge to form a gap between said intermediate bottom and the lower edge of the baffle guide ring. Damming means, for example, in the form of a circular ring wall are arranged radially outwardly of said gap to form a back-up zone for the sugar solution, the remaining sugar crystals, and air radially inwardly of said gap. Preferably, the upper edge of the damming ring wall extends to a level above said gap.

A discharge conduit for the sugar solution is connected to the space outside said damming ring wall, whereby the discharge conduit preferably extends downwardly through said intermediate bottom and then out of the outer housing.

BRIEF FIGURE DESCRIPTION

In order that the invention may be clearly understood, it will now be described, by way of example, with reference to the accompanying drawings, wherein:

FIG. 1 is a sectional view through a continuously operable centrifuge according to the invention, whereby the section extends axially through the rotational axis of the centrifuge; and FIG. 2 is a sectional view similiar to that of FIG. 1, however, showing a detail on an enlarged scale.

DETAILED DESCRIPTION OF EXAMPLE EMBODIMENTS

Figure 1:
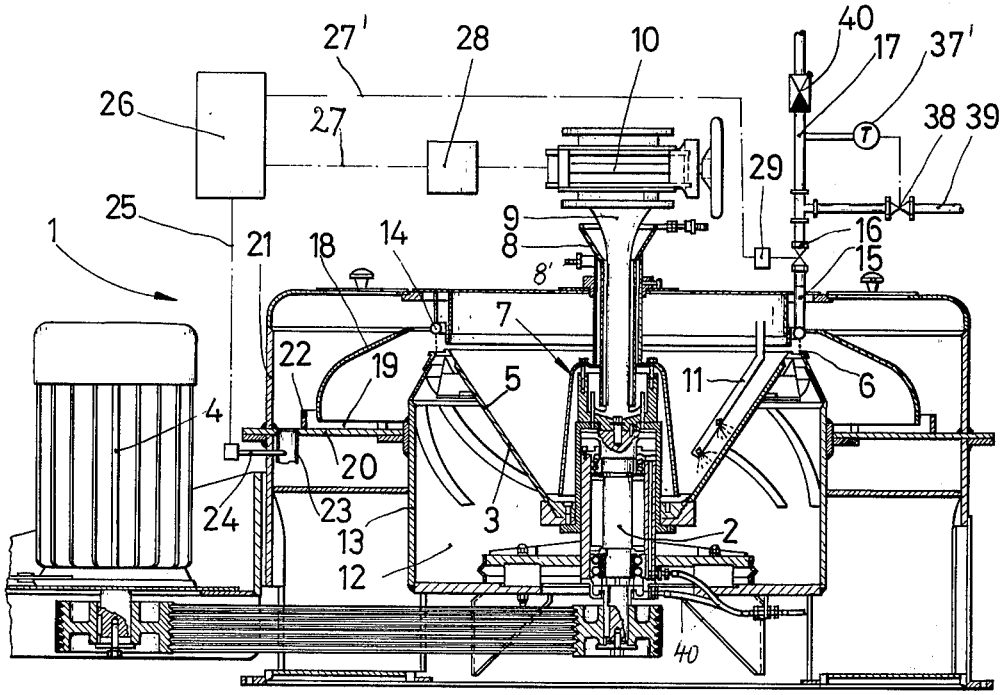

FIG. 1 illustrates a continuously operable centrifuge 1 having a rotatably supported vertical drive shaft 2. A centrifuging screen basket 3 is secured to the drive shaft 2, which in turn is driven by a drive motor 4. The screen basket 3 has a conical screen 5 of conventional construction. The screen basket 3 comprises an upper rim 6 extending substantially radially outwardly. The centrifuged sugar crystals emerge from the basket thereby travelling over this rim 6. The bearings of the drive shaft 2 are lubricated through lubricating-pipes 40. Centrally in the basket 3 there is arranged an accelleration and massecuite distribution cup 7. A massecuite supply device 8 reaches through the cover of the outer housing 21 into the cup 7 so that the massecuite 9 may centrally flow into the distribution device. A massecuite supply control valve 10 regulates the selectable quantity of the massecuite which due to the centrifuging is separated into the sugar crystals passing over the rim 6 and into the liquid component which is collected in the space 12 provided by the inner housing 13. A pipe 11 provided with spray nozzles is connected to a suitable water and/or steam supply and reaches into the basket 3 for spraying the sugar crystals travelling upwardly on the centrifuge basket wall with water or steam. The liquid component which passes through the screen 5 and which is collected in the collection space 12 surrounded by the housing 13 is removed from the space 12 by conduit means, not shown.

According to the invention the centrifuge is provided with means for dissolving the sugar, as it emerges from the basket 3 over the upper rim 6. For this purpose, there is provided above and axially spaced from the upper rim 6 a circular ring pipe 14 connected to supply conduit means 15 and 17. A quantity control valve 16 for regulating the solvent quantity is arranged in the supply conduit 15, 17. Furthermore, a baffle guide ring 18 is arranged inside the outer housing 21. The upper edge of the baffle guide ring 18 is slightly radially spaced from the ring pipe 14. The baffle guide ring 18 may be somewhat bell shaped or curved as shown. An inverted bowl shape may also be suitable for the baffle guide ring 18. The illustrated embodiment has an upper conical portion slanting radially outwardly and downwardly and merging into a curved downwardly extending portion. The upper conical slanted portion faces the gap between the ring pipe 14 and the upper rim 6 of the basket 3. Thus, the sugar emerging over the rim 6 impinges upon the slanted upper portion of the baffle guide ring 18. The lower edge of the curved portion extends substantially vertically and reaches to a level slightly above an intermediate bottom 20 arranged between the inner housing 13 and the outer housing 21. Thus, a gap 19 is provided between the inner or intermediate bottom 20 and the lower edge of the baffle guide ring 18. The gap 19 may, for example, have a width ranging from about 2 mm to about 30 mm. Preferably the intermediate bottom 20 extends horizontally. A damming wall or ring 22 is arranged radially outwardly of the gap 19 and spaced from the gap 19. The damming ring 22 has a vertical height of about 5 mm to about 50 mm, so that the upper edge of the rim 22 will be located above the level defined by the gap 19.

A discharge pipe 23 for the sugar solution is connected to the space above the intermediate bottom 20 in the outer housing 21. As shown, the discharge pipe 23 extends downwardly through the bottom 20 and then out of the housing 21. However, the pipe 23 may also extend directly through the wall of the housing 21 just immediately adjacent and above the bottom 20.

A precision measuring thermometer 24 is arranged to measure the temperature of the sugar solution flowing through the pipe 23. The thermometer 24 is operatively connected through a conductor 25 to a control apparatus 26 which will normally be a conventional amplifier for amplifying the electrical signal representing the temperature measured by the thermometer 24. The amplifier 26 has one output 27 operatively connected to a drive mechanism 28 such as a motor or a solenoid, which in turn is operatively connected to the quantity control valve 10 for regulating the quantity of massecuite 9 supplied through the valve 10 into the centrifuge from a supply container not shown. A further output 27′ of the amplifier 26 is operatively connected to further drive means 29, which may also be a solenoid, motor, or the like operatively connected to the valve 16 for controlling the quantity of sugar solvent, such as water supplied to the ring pipe 14.

Figure 2:
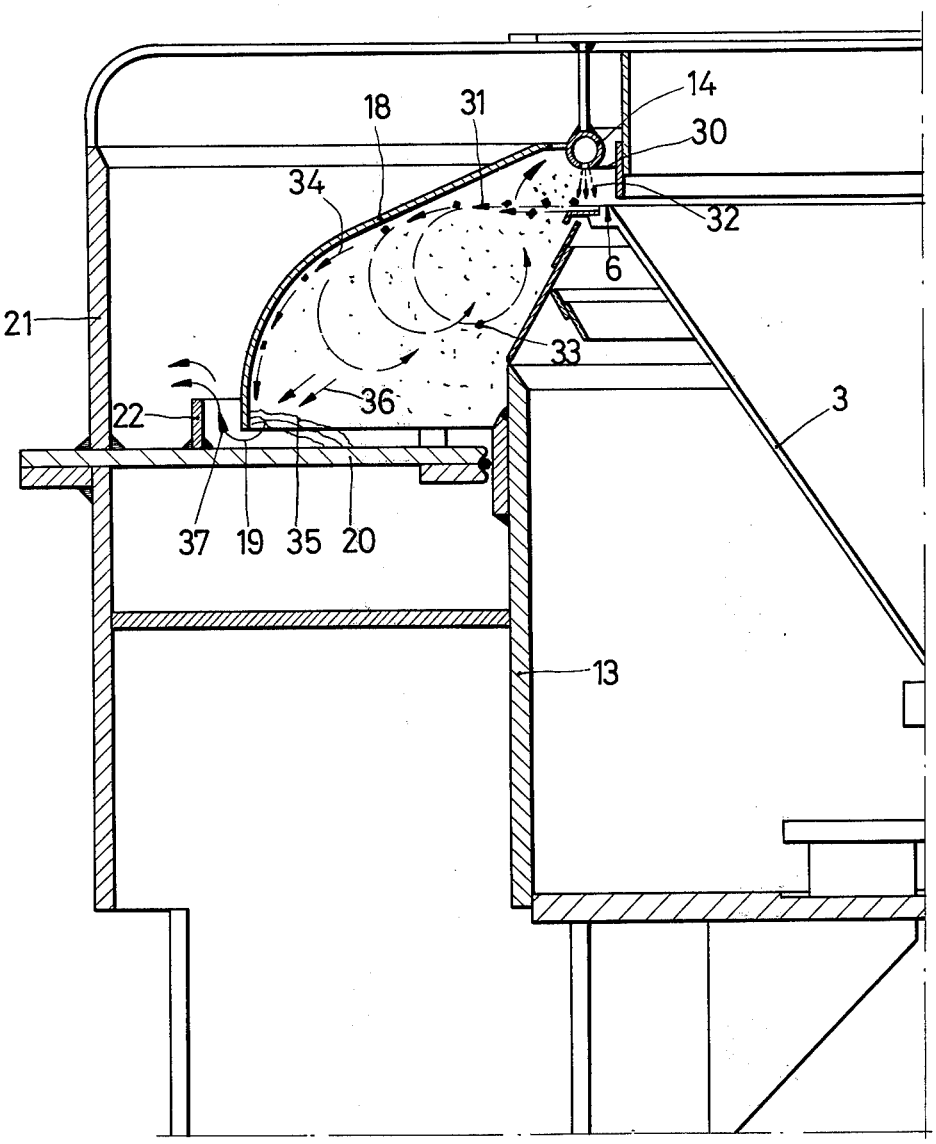

FIG. 2 shows that the sugar solvent supply pipe 14 is provided with a plurality of nozzles 30 arranged to face downwardly toward the upper rim 6 of the basket 3. The operation of the present centrifuge will now be described, especially with reference to FIG. 2. The massecuite 9, flowing through the quantity control valve 10 and preferably having a constant temperature, flows through the feed-in mechanism 8 and through the distribution and accelleration mechanism 7 into the basket 3 where it is separated into the solid component, namely the sugar and into a liquid component. The sugar is, if desired, covered with water or vapor through the pipe 11 (FIG. 1) and emerges from the basket over the upper rim 6 of the basket.

The solvent is sprayed through the nozzles 30 of the ring pipe 14 in a generally downward direction 32 at an angle to the flow direction 31 of the sugar crystals. Preferably, the solvent has a temperature in the range from room temperature to about 99° C. Further, the solvent should have a pressure of at least 14.2 pounds per square inch (gauge). The quantity of the solvent is controlled by continuously measuring the temperature of the sugar solution as described above.

In FIG. 2 it will be appreciated that the arrows 31 only illustrate one component of the direction of movement of the sugar crystals because due to the rotation of the basket 3 such direction of movement will have a second component extending substantially perpendicularly relative to the plane of the drawing.

Due to the arrangement of the ring pipe 14 and the nozzles 30, the sugar crystals and the jets 30 of the solvent meet each other at rather high speeds so that large kinetic energies become effective causing an efficient intermixing and enveloping of the sugar crystals and the solvent, whereby a turbulent flow of solvent mist if created. The creation of such turbulent flow is enhanced by the rather strong turbulent air flow due to the rotation of the centrifuging basket 3. The turbulent flow of a dense liquid solvent mist is indicated by the arrow 33. The turbulent flow also includes the formation of eddys and the sugar crystals are forced to travel through this turbulent mist of solvent. Immediately upon the first contact between the solvent and the sugar crystals, an intensive material exchange takes place which instantaneously causes an intensive dissolution of the sugar crystals. This material exchange continues as the sugar crystals are forced to travel through the dense, fine mist as indicated by the arrows 31, whereby an intense liquid exchange takes place which enhances the solving of the sugar crystals. In other words, the liquid layer enveloping the sugar crystals is continuously, forcefully exchanged thereby enhancing the efficient solving of the sugar crystals. Furthermore, the sugar crystals which impinge upon the baffle guide ring 18 are comminuted, which also enhances the dissolution. The turbulent flow of solvent mist, air, sugar crystals, and solution then continues along the inner surface of the baffle guide ring 18, as indicated by the arrows 34 and also in the direction indicated by the arrows 33, whereby high mechanical forces are effective causing the above mentioned comminution, as well as an intensive mixing and stirring.

By the mentioned mixing and stirring in combination with the turbulent and eddy flow, as indicated at 33, an efficient dissolution of the sugar crystals is accomplished so that in the back-up zone 35 substantially all of the sugar crystals have been dissolved. This back-up zone 35 is caused by the narrow gap 19 and the damming ring wall 22. Only a few remaining sugar crystals may be found in the back-up location 35. The sugar solution, air, solvent, and remaining crystals arriving at the back-up location or zone 35 are forced through the gap 19 and over the ring wall 22 as indicated by the arrows 37 due to a pressure or rather a flow effect, as indicated by the arrows 36. Such flow effect 36 is caused because steam is supplied into the space inside the basket 3 through an inlet conduit 8' and due to the high rotational speed of the centrifuging basket 3 which causes a ventilation effect. Thus, the intimately and intensively mixed combination of liquid mist, air, liquid, and sugar solution passes through the slot 19 and over the damming or back up ring wall 22. It has been found that the resulting back-up effect assures the complete dissolution of the sugar crystals so that no sugar crystals remain in the solution as the latter flows out through the conduit pipe 23. Experiments have shown that in the just described manner it is possible to achieve sugar solutions having a sugar concentration in the range of about 60 to 70 Brix.

The density or concentration of the sugar solution may be controlled by means of the above mentioned precision thermometer 24. This is so because the temperature of the sugar solution depends on the temperature and the quantity of the supplied massecuite, as well as on the temperature and quantity of the supplied solvent liquid. Assuming that the temperature of the massecuite is lower than the temperature of the solvent liquid, then a lowering of the temperature of the sugar solution flowing through the outlet conduit 23 means that too much massecuite or too little solution liquid has been supplied to the centrifuge. Accordingly, the density or the concentration of the sugar solution in Brix values would rise. On the other hand, if we assume that the temperature of the sugar solution in the conduit 23 rises the opposite situation would hold true, namely, that insufficient massecuite and too much liquid solvent are supplied. Based on these findings the control amplifier 26 and the respective operative connections 25, 27 and the control means 28 and 29 are actuated in response to the temperature measured by the precision thermometer 24 in order to control the quantity of the massecuite and/or the quantity of the pressurized liquid solvent. In this context it is assumed for the proper operation of the density control as just described, that is, of the concentration of the produced sugar solution that the temperatures of the liquid solvent and of the massecuite are constant. If these temperatures should not be constant, respective compensating control functions would have to be embodied in the control amplifier 26.

If it should happen that the supply of liquid solvent is suddenly stopped for some reason or another, for example, if a pump should fail, the centrifuge would be clogged in a rather short time. In order to minimize the probability of such an occurrence, a pressure gauge 37' is connected to the supply conduit 17. The pressure gauge 37' is connected to a valve 38 arranged in an auxiliary liquid solvent supply conduit 39. Thus, any failure in the supply of liquid solvent through the conduit 37 will immediately cause the opening of the valve 38 for supplying liquid solvent through the conduit 39.

A non-return valve 40 in the conduit 17 is provided to prevent liquid solvent from flowing into the conduit 17 from the auxiliary conduit 39.

Normally, the liquid solvent would be a so called clarified juice which is a low concentration juice. However, it is also possible to employ as the liquid solvent a condensate or respectively pretreated water. Even syrup may be used as the liquid solvent.

In view of the foregoing, it will be appreciated that by measuring the temperature of the sugar solution in the discharge conduit 23 it is possible to maintain the concentration of the solution at a predetermined high Brix value by comparing the measured value with a reference value in a known discriminating type circuit, which may be part of the amplifier device 26. Deviations from the reference value are then used as control signals for regulating the massecuite quantity and the solvent liquid quantity, whereby the temperatures of these quantities are kept at constant values which differ slightly from each other. Deviations from such constant values may be taken into account as part of the control function of the amplifier device 26.

Contrary to the above described prior art methods, which mostly aim as facilitating the sugar discharge from the centrifuge, the invention achieves a complete dissolution of the sugar, whereby the sugar solution may have a concentration in the range of 60 to 70 Brix as mentioned. The important advantage of this feature of the invention is seen in that the sugar solution with the just mentioned concentration is immediately ready for filtration without any intermediate process steps. It is believed that the reason for achieving the complete dissolution of the sugar crystals as well as for obtaining a high solution density or concentration resides in the fact that according to the invention all advantageous features of a continuously operable centrifuge are combined in an efficient manner to assure a multiple mechanical interaction between the solvent liquid and the sugar crystals. Especially, by directing the solvent jets at an angle, for example, a right angle, onto the sugar crystals where the latter have the highest speed, an intense and intimate interaction between sugar crystals and liquid solvent is assured by the creation of the above described turbulent flow. The speed differences between the sugar crystals and the liquid solvent jets are the largest at this point, whereby substantial kinetic energies become effective in causing an intensive interface exchange between liquid and solids. The liquid is dispersed by the high air turbulence flow at this point, as well as by the collision with the sugar crystals, whereby very fine droplets are formed which are distributed in the form of a turbulent mist in the space below the baffle guide ring 18. The sugar crystals must travel through this mist whereby they are repeatedly exposed to an exchange of the enveloping layers, whereby the dissolution process progresses and even snowballs.

In addition, the impinging of the sugar crystals on the slanted surface of the baffle guide ring 18 partially or completely destroys the sugar crystals, which also enhances the dissolution, especially in combination with the turbulent flow of the liquid mist as described. The comminution or destruction of the sugar crystals also enhances the efficiency of the solution because the contact surface between liquid and solid sugar is thereby increased. Such contact and interaction is further enhanced by the flow or movement along the surface of the rigid baffle guide plate 18 and by the air turbulences. The turbulent flow is even effective in the back-up zone 35 whereby eddys are formed in this back-up zone. The combination of all of the just described effects assures that only very few sugar crystal remainders are still present in the back-up zone. Most of the sugar is already in solution in this zone, and a complete solution is then accomplished by pressing the mixture from the back-up zone through the slot 19 and over the back-up wall 22. The above venting effect which intermixes air and liquid mist with the sugar solution in the back-up zone provides for a still further mechanical influence enhancing the complete solution.

The most important advantage of the invention is seen in that a high concentration and high purity sugar solution may be produced in a continuously operating process and apparatus. Especially a high purity may be achieved by an intensive purging. The sugar solution then merely requires a filtering and the usual conversion into so called invert sugar for use as a liquid sugar.

Although the invention has been described with reference to specific example embodiments, it is to be understood, that it is intended to cover all modifications and equivalents within the scope of the appended claims.

What is claimed is:

1. A process for continuously centrifuging massecuite to produce sugar crystals and again dissolving said sugar crystals to produce a sugar solution, comprising continuously introducing massecuite into a centrifuge having a centrifuging basket with an upper rim, to produce sugar crystals, pressurizing a liquid solvent, continuously contacting said sugar crystals with said pressurized liquid solvent by directing jets of said pressurized liquid solvent onto the sugar crystals where these sugar crystals pass over said upper rim of the centrifuging basket to thereby generate a turbulent flow of a liquid solvent mist and to envelope the sugar crystals with liquid solvent, forcing the enveloped sugar crystals through said liquid turbulent flow of liquid solvent mist against baffle guide means, guiding said enveloped sugar crystals along said guide means into a back-up zone of sugar solution, and driving the sugar solution together with air and liquid mist through a gap and over a damming wall out of the centrifuge.

2. The process of claim 1, wherein said jets of pressurized liquid solvent are directed onto said sugar crystals from above at an angle to the travel direction of the sugar crystals.

3. The process of claim 1, wherein said forcing of the enveloped sugar crystals against said baffle guide means comminutes said crystals.

4. The process of claim 1, further comprising measuring the temperature of the sugar solution, comparing the measured temperature with a reference value to produce control signals representing temperature deviations from said reference value, and controlling the supply of the massecuite and/or the supply of the liquid solvent in response to said control signals to maintain the temperature of the massecuite or of the liquid solvent constant.

5. The process of claim 4, further comprising maintaining a temperature difference within the range from 1° to 60° C between the temperature of the supplied massecuite and the temperature of the supplied liquid solvent.

6. A centrifuge for continuously producing sugar solution, comprising a centrifuging basket, support means including an axially extending drive shaft for said basket, an inner housing, means securing said basket to said drive shaft inside said inner housing, said basket having an upper rim over which sugar crystals emerge from said basket, an outer housing surrounding said inner housing, massecuite supply means extending through said outer housing into said basket, liquid solvent supply means arranged in said second housing to face said upper rim of the basket, said solvent supply means comprising a circular pipe with a plurality of nozzles therein directed substantially toward said upper rim of the basket, solvent conduit means operatively connected to said circular pipe, guide baffle ring means located in said second housing radially spaced from said upper rim of the basket, said guide baffle ring means curving radially outwardly and downwardly, an intermediate bottom between said inner and outer housings, said guide baffle ring means having a lower edge spaced from said intermediate bottom to form a ring gap between said lower edge and said intermediate bottom, and damming means secured to said intermediate bottom to surround said ring gap in spaced relation thereto.

7. The centrifuge according to claim 6, wherein said circular solvent supply pipe is axially spaced above said upper basket rim, said circular supply pipe and said upper basket rim having substantially the same diameter.

8. The centrifuge according to claim 6, wherein said guide baffle ring means have a curvature facing toward said basket, said curvature having a radius of curvature which decreases from a point adjacent to said circular solvent supply pipe to a point on said lower edge of said guide baffle ring means.

9. The centrifuge according to claim 6, wherein said ring gap has an axial height of from about 2 mm to about 30 mm.

10. The centrifuge according to claim 6, wherein said damming means have an axial height of about 5 mm to about 50 mm, whereby the damming means extend above said ring gap.

11. The centrifuge according to claim 6, further comprising sugar solution discharge means extending out of said outer housing, temperature sensing means arranged to ascertain the temperature of said sugar solution, dosing means, and control means operatively interconnected between said temperature sensing means and said dosing means for controlling the supply of massecuite and/or liquid solvent to maintain said temperature substantially constant, whereby the sugar concentration is maintained substantially constant.

12. The centrifuge according to claim 6, wherein said guide baffle ring means has a substantially conical wall portion extending away from said circular solvent supply pipe, and a curved wall portion merging into said conical wall portion, said curved wall portion having a concave surface facing toward said basket.

* * * * *

UNITED STATES PATENT OFFICE
CERTIFICATE OF CORRECTION

Patent No. 4,008,098 Dated February 15, 1977

Inventor(s) Walter Dietzel et al

It is certified that error appears in the above-identified patent and that said Letters Patent are hereby corrected as shown below:

[30] Foreign Application Priority Data
--Nov. 11, 1975 Germany .....2550496--

Signed and Sealed this
Nineteenth Day of April 1977

[SEAL]

*Attest:*

RUTH C. MASON
*Attesting Officer*

C. MARSHALL DANN
*Commissioner of Patents and Trademarks*